US009236168B2

(12) United States Patent
Adams et al.

(10) Patent No.: US 9,236,168 B2
(45) Date of Patent: Jan. 12, 2016

(54) METHODS FOR MANUFACTURING AN ELECTRICAL CABLE

(71) Applicant: Andrew LLC, Hickory, NC (US)

(72) Inventors: Scott M. Adams, Catawba, NC (US); Douglas J. Blew, Mooresville, NC (US); Frank A. Harwath, Naperville, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 14/315,273

(22) Filed: Jun. 25, 2014

(65) Prior Publication Data

US 2015/0000123 A1 Jan. 1, 2015

Related U.S. Application Data

(60) Provisional application No. 61/839,622, filed on Jun. 26, 2013.

(51) Int. Cl.

| | |
|---|---|
| ***H01B 13/20*** | (2006.01) |
| ***H01B 13/14*** | (2006.01) |
| ***H01B 13/00*** | (2006.01) |
| ***B21C 37/04*** | (2006.01) |
| *H01B 7/00* | (2006.01) |

(52) U.S. Cl.

CPC ..... *H01B 13/14* (2013.01); *B21C 37/045* (2013.01); *H01B 13/0006* (2013.01); *H01B 7/0018* (2013.01); *Y10T 29/49117* (2015.01)

(58) Field of Classification Search

CPC ..... H01B 7/04; H01B 7/08; H01B 11/1869; H01B 13/004; H01B 13/008; H01B 13/0165; H01B 13/067; H01B 17/58; H01B 17/62; Y10T 29/49117; Y10T 29/49123; Y10T 29/49135

USPC ..... 29/417, 561, 563, 564.6, 566.1, 825, 29/828, 83; 264/250, 254, 259, 271.1, 264/294, 295, 275; 174/115, 129 R, 133 R

See application file for complete search history.

(56) References Cited

U.S. PATENT DOCUMENTS

| | | | |
|---|---|---|---|
| 2,200,776 | A | 5/1940 | Hoover |
| 3,828,120 | A | 8/1974 | Hansen |
| 3,996,780 | A | 12/1976 | German |

(Continued)

FOREIGN PATENT DOCUMENTS

KR 1020050087545 8/2005

OTHER PUBLICATIONS

Jae Neon Jeong, International Search Report for PCT/US2014/044275, Oct. 16, 2014, Daejeon Metropolitan City, Korea.

*Primary Examiner* — Paul D Kim

(74) *Attorney, Agent, or Firm* — Babcock IP, PLLC

(57) ABSTRACT

A method for manufacturing an electrical cable includes dividing a tube into a plurality of sectors by passage across a sectoring device, gathering the sectors into a stack by passage of the sectors through a gathering device, and surrounding the stack with an insulating layer. Additional strip features may be applied by application of one or more strip conditioners. Alternatively, strips may be supplied on individual reels for gathering or provided in a multi-end reel already stacked. Where a multi-end reel is provided, length differentials within the stack as it is unwound may be compensated for by application of a stretcher.

10 Claims, 4 Drawing Sheets

(56) References Cited

U.S. PATENT DOCUMENTS

| | | | | |
|---|---|---|---|---|
| 4,019,282 | A | 4/1977 | Cauffiel | |
| 4,043,494 | A | 8/1977 | Bickford et al. | |
| 4,051,809 | A | 10/1977 | Zickar et al. | |
| 4,059,000 | A | 11/1977 | Bodnar | |
| 4,073,966 | A | 2/1978 | Scholes et al. | |
| 4,183,181 | A | 1/1980 | Kitazawa | |
| 4,199,854 | A * | 4/1980 | Bitting et al. | 29/426.5 |
| 4,233,832 | A | 11/1980 | Rowell | |
| 4,711,009 | A | 12/1987 | Cornelison et al. | |
| 4,798,932 | A | 1/1989 | Dion et al. | |
| 4,961,334 | A | 10/1990 | Barnes | |
| 5,029,553 | A | 7/1991 | Cox | |
| 5,040,397 | A | 8/1991 | Bodnar | |
| 5,381,342 | A | 1/1995 | Noe | |
| 5,847,324 | A | 12/1998 | Farquhar et al. | |
| 5,850,773 | A | 12/1998 | Burns | |
| 6,005,193 | A | 12/1999 | Markel | |
| 6,218,622 | B1 | 4/2001 | Rimmer | |
| 6,256,439 | B1 | 7/2001 | Brown et al. | |
| 6,327,883 | B1 | 12/2001 | Noe et al. | |
| 6,340,795 | B1 | 1/2002 | Caldwell | |
| 6,439,883 | B1 | 8/2002 | Hanton et al. | |
| 6,571,449 | B2 * | 6/2003 | Adamczak et al. | 29/417 |
| 6,581,291 | B1 | 6/2003 | Tarpill et al. | |
| 6,608,256 | B2 | 8/2003 | Suzuki et al. | |
| 7,111,487 | B2 | 9/2006 | Yong et al. | |
| 7,188,406 | B2 * | 3/2007 | Varkey et al. | 29/825 |
| 8,343,291 | B1 | 1/2013 | Loen et al. | |
| 8,595,922 | B2 * | 12/2013 | Lind et al. | 29/825 |
| 8,732,946 | B2 * | 5/2014 | Harmason et al. | 29/868 |
| 8,943,686 | B2 * | 2/2015 | Hartford et al. | 29/869 |
| 2002/0195478 | A1 | 12/2002 | Yamano et al. | |
| 2006/0016615 | A1 | 1/2006 | Schilson et al. | |
| 2008/0029290 | A1 | 2/2008 | Kuo | |
| 2011/0155417 | A1 | 6/2011 | Hu | |
| 2012/0181060 | A1 | 7/2012 | Chen et al. | |

* cited by examiner

METHODS FOR MANUFACTURING AN ELECTRICAL CABLE

CROSS REFERENCE TO RELATED APPLICATIONS

This application claims the benefit of US Provisional Patent Application titled "FLEXIBLE ELECTRICAL POWER CABLE AND METHODS OF MANUFACTURE", Ser. No. 61/839,622 filed 26 Jun. 2013 by Scott Adams, Douglas Blew, Frank Harwath and Ronald Vaccaro, hereby incorporated by reference in the entirety.

BACKGROUND OF THE INVENTION

Traditional electrical power cables typically comprise large gauge copper conductors with a circular cross-section. However, such power cables are heavy, difficult to bend and have a high material cost directly related to the rising cost of copper metal.

Cost and weight efficient aluminum power cables are known. To deliver the same current capacity an aluminum power cable requires an increased cross-sectional area. As the diameter of a power cable increases with increasing power capacity, the bend radius of the power cable increases.

An electrical cable comprising a plurality of flat conductors arranged in a stack has numerous advantages over a conventional circular cross-section copper power cable. Because the desired cross-sectional area may be obtained without applying a circular cross-section, an improved bend radius may be obtained. If desired, the significant improvements to the bend radius enables configuration of the cable with increased cross-sectional area. This increased total cross-sectional area, without a corresponding increase in the minimum bend radius characteristic, may also enable substitution of aluminum for traditional copper material, resulting in materials cost and weight savings.

In addition to the aluminum versus copper material cost savings, the weight savings for an electrical cable with aluminum conductors installed upon a radio tower may be especially significant, as an overall weight savings enables a corresponding reduction in the overall design load of the antenna/transceiver systems installed upon the radio tower/support structure. Further, the improved bending characteristics of the flexible electrical power cable may simplify installation in close quarters and/or in remote locations such as atop radio towers where conventional bending tools may not be readily available and/or easily applied. Because complex stranding structures which attempt to substitute the solid cylindrical conductor with a woven multi-strand conductor structure to improve the bend radius of conventional circular cross-section electrical power cables may be eliminated, required manufacturing process steps may be reduced and quality control simplified.

However, compared to well known methods of materials provision/delivery and/or manufacture for conventional circular cross-section conductors, significant manufacturing issues may arise during flat conductor cable manufacture.

Competition within the electrical power transmission cable and in particular the Remote Radio Head systems market has focused attention upon reducing materials and manufacturing costs, providing cost efficiencies for radio tower electrical power delivery and overall improved manufacturing quality control.

Therefore, it is an object of the invention to provide methods of manufacture for an electrical power cable that overcome deficiencies in such prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

The inventors have recognized that processing of the raw conductive strips into the multiple layer cable introduces issues with respect to efficiently preparing and combining continuous lengths of the conductive strip layers accurately indexed upon one another and/or compensating for length disparities between layers of pre-stacked layers of strips that are stored in packaging containers, for example as coils wound about the supporting core of a reel.

Figure 1:
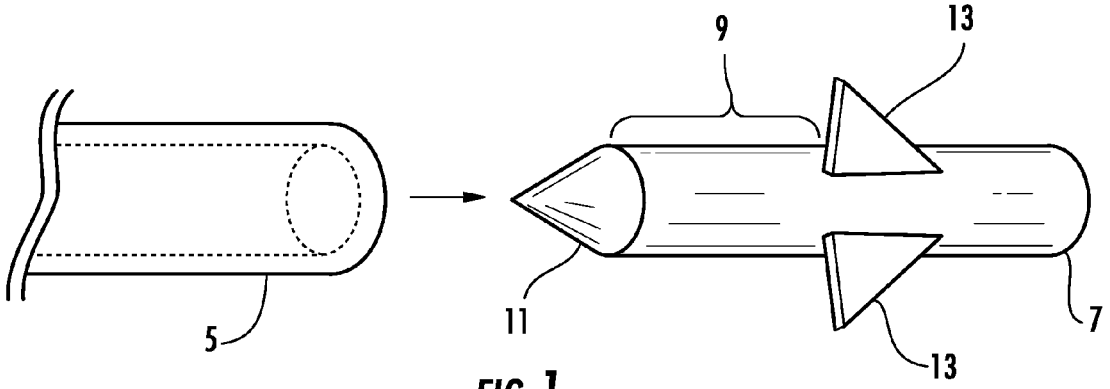
FIG. 1 is a schematic view of a cylindrical tube of conductive material and an exemplary sectoring device dimensioned for insertion therewithin.

A plurality of sectors 3, a curved cross-section precursor to flattened conductive strips 15, may be obtained by passing a tube 5 of the desired conductive material (such as an aluminum alloy) through a sectoring device 7, for example as shown in FIG. 1. The tube 5 may be provided, for example, as a seamless extrusion or seam welded tube.

The tube 5 may be guided onto the sectoring device 7 by a lead-in feature 9 which can be, for example, tapered, conical or rounded. Once the tube 5 is engaged on the sectoring device 7, its position on center is maintained by a guiding mandrel 11. The diameter of the guiding mandrel 11 may be dimensioned to center the tube 5 upon the guiding mandrel 11 by nearly matching the inner diameter of the tube 5. Alternatively the guiding mandrel 11 may include a taper to an outer diameter that slightly exceeds the inner diameter of the tube 5 causing the tube 5 to expand slightly as it passes thereover. Advancing across the guiding mandrel 11, the tube 5 encounters a plurality of tube cutters 13 that are spaced about the circumference of the sectoring device 7. There can be as few as one tube cutter 13, or a plurality spaced, for example, equally apart along the outer diameter of the guiding mandrel. Where a seam welded tube 5 is applied, any dimensional variances caused by the presence of the seam along the tube 5 may be discarded by spacing the tube cutters 13 to form one sector 3 which is dimensioned to include the seam, and then discarding this sector 3.

Figure 2:
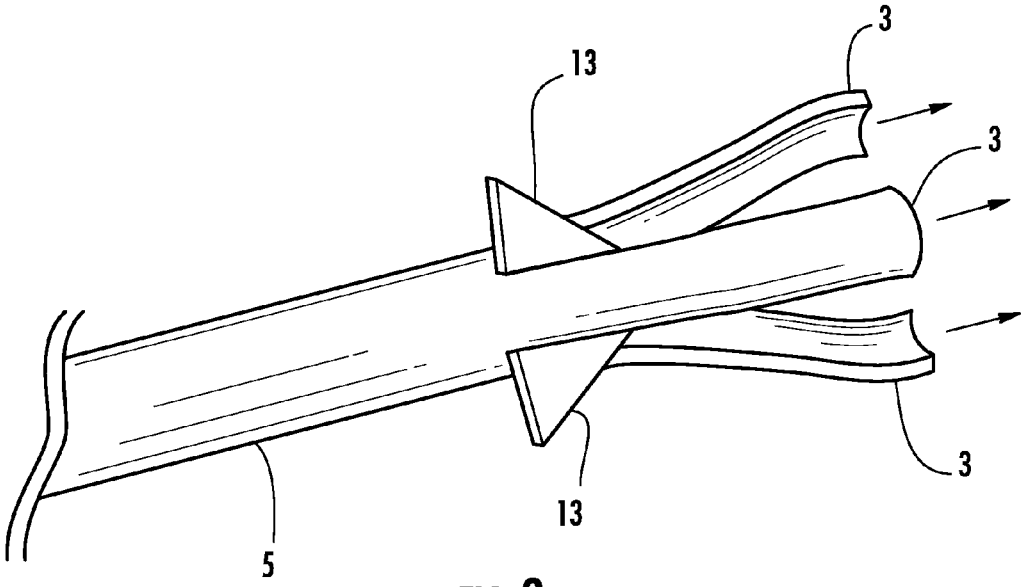
FIG. 2, is a schematic view of the sectoring device of FIG. 1, in operation as the tube travels across the sectoring device.

As shown in FIGS. 1 and 2, an exemplary sectoring device 7 embodiment has three tube cutters 13 on the sectoring device 7 (two of which are visible and one that is hidden from view). The tube cutters 13 are demonstrated as fixed knives with a sharpened edge. One skilled in the art will appreciate that the tube cutters 13 may alternatively be rotating and/or reciprocating knives, saws, or other cutting methods known in the art.

Alternatively, the guiding mandrel 11 may be provided as a bore that engages the tube 5 along the outer diameter. The bore is provided with an inner diameter dimensioned to guide the tube 5 past tube cutters 13 mounted therealong. The bore may also be formed via a plurality of rollers. Each of the rollers providing an arc sector of the overall circumference of the desired bore dimension. The arc sectors of each roller may overlap one another, by spacing the rollers longitudinally along the bore, the rollers together forming the outer diameter of the bore in concert with one another.

FIG. 2 demonstrates the cutting of the tube into sectors 3 via passage across the sectoring device 7. Upon further processing, such as flattening, these sectors 3 provide the individual conductive strips 15 for further processing that may be a batch or continuous process as described in detail hereafter. If a batch process is applied, the sectors may be collected upon individual reels.

Figure 3:
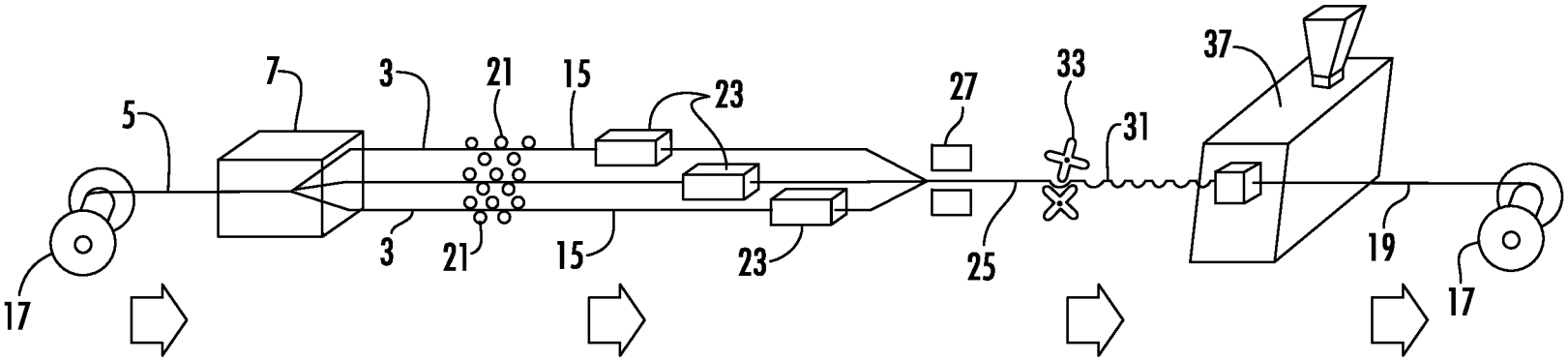
FIG. 3 is a schematic process diagram for an exemplary cylindrical tube fed continuous method of manufacture.

In a first embodiment of a continuous cable manufacture process, as shown for example in FIG. 3, a length of tube 5 is fed into the process from a packaging container 17, for example by unrolling from a reel. The tube 5 is fed into the sectoring device 7 where the tube 5 is divided into a plurality of sectors 3. The sectors 3 to be used in the insulated conductor 19 may be rolled into a uniformly flat rectangular cross-section by passage through flattening rollers 21 from which they emerge as flat conductive strips 15.

Figure 5:
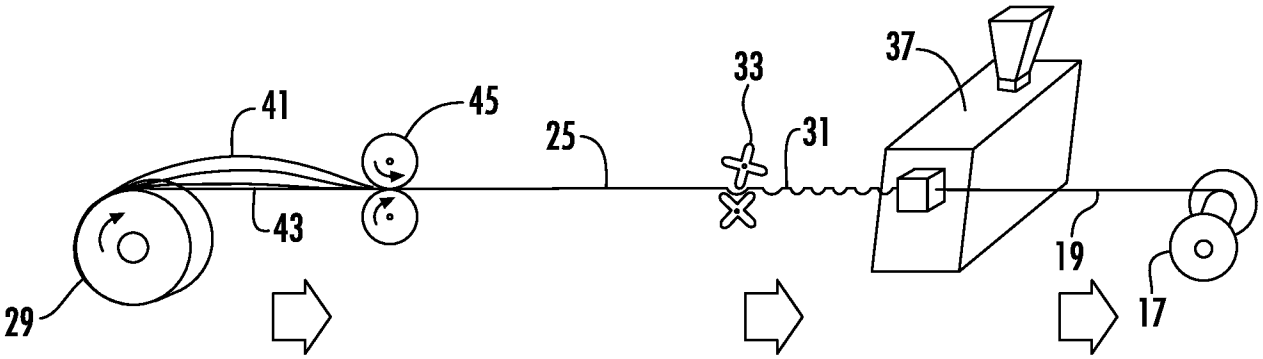
FIG. 5 is a schematic process diagram for an exemplary conductive strip stack multi-end reel fed continuous method of manufacture.

The conductive strips 15 may be optionally fed into one or more strip conditioners 23. The strip conditioners 23 may impart any combination of dimensional, surface or other forming treatments, such as slitting, skiving, rolling, lubricating, texturing, embossing, peening, cambering, folding, or corrugating. The plurality of conductive strips 15 are next gathered one upon the other, along a horizontal axis (the longer dimension of the conductive strip 15 cross-section defined as the horizontal axis), into a stack 25 by passage through a gathering tool 27. Where insulating coatings are not applied, for example by a strip conditioner 23, the one upon the other stacking of the conductive strips 15 places them in direct electrical contact with one another. Where a batch process is applied, the stack 25 may be gathered into a multi-end reel 29 (for use as the input for further processing, as shown in FIG. 5).

In a continuous process, the stack 25 continues without interruption or intermediate collection. The stack 25 may be optionally provided with a corrugated pattern 31 by passage through corrugator 33 (in addition to any applied to individual conductive strips 15 by the strip conditioner(s) 23, if present) with respect to the entire stack 25.

Once the stack 25 is complete, a protective and/or insulating jacket 35 may be applied there around, for example by passage of the stack 25 through an insulator extruder 37 to form an insulated conductor 19. The jacket material may be, for example, polymer based, such as PE, PVC, rubber, nylon, PET or the like.

The insulated conductor 19 is then put in a suitable packaging container 17 such as wound upon a reel.

Figure 4:
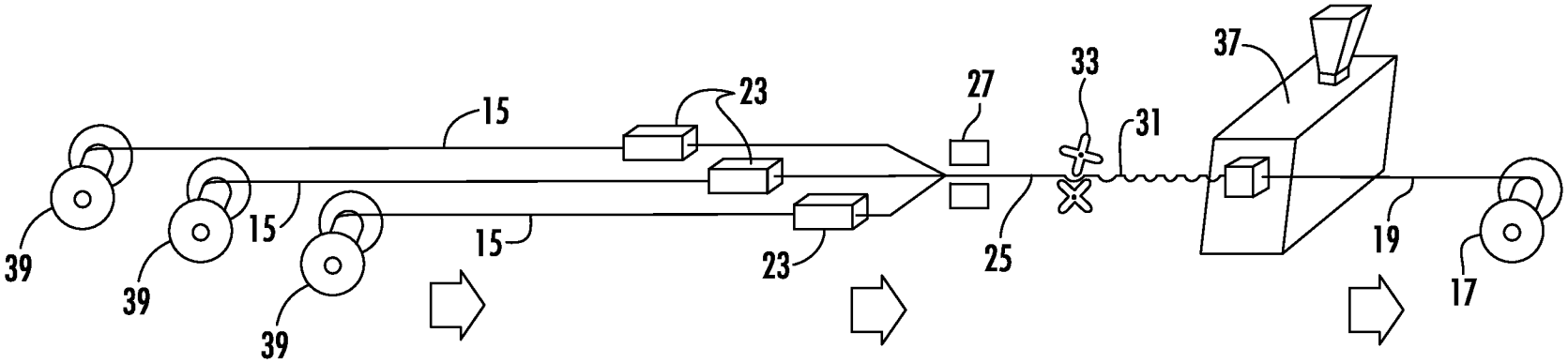
FIG. 4 is a schematic process diagram for an exemplary individual conductive strip single end reel fed continuous method of manufacture.

In an alternative continuous process starting from individual strip reels 39 of single conductive strips 15 already processed through any desired strip conditioner(s) 23, for example as shown in FIG. 4, a plurality of reels 39 providing the desired number of layers of the finished insulated conductor 19 may be directly fed into the gathering tool 27 or alternatively processed in-line through strip conditioner(s) 23, as previously described, and then fed into the gathering tool 27 to form a stack 25. Again, the stack 25 may be optionally treated by a corrugator 33 to produce a corrugated pattern 31 with respect to the entire stack 25. The stack 25 may be further fed into an insulating extruder 37 and covered with insulating material (jacket) to form an insulated conductor 19. The insulated conductor 19 is then put in a suitable packaging container 17 such as wound upon a reel.

In a further alternative continuous process starting from a multi-end reel 29 (a coil of a stack 25), compensation for the length differential between the outer layer strip 41 versus the inner layer strip 43 of the stack 25 is provided by passing the conductive strips 15 through a stretcher 45. The stretcher 45 operates in tension with respect to a feed rate of the multi-end reel 29, the tension applied stretching the shorter inner layer strip 43 to the length of the outer layer strip 41 (and similarly any internal layers of conductive strips 15 to a lesser extent depending upon their position in the stack 25) so that upon exit of the stretcher 45, the conductive strips 15 of the stack 25 are each of the same length to enable the remainder of processing into an insulated conductor 19 as previously described, without disrupting progressive length differentials being introduced into the process while the multi-end reel 29 runs from full to empty.

The amount of stretching required for each layer from the stretcher 45 may be calculated as follows. Where a stack 25 of conductive strips 15 is applied, each of the layers on a multi-end reel 29 will have a circumference that increases with respect to each successive layer of the stack 25, due to the thickness of the layer below increasing the radius of the next layered conductive strip 15 from the center of the multi-end reel 29.

At an exemplary "full" reel diameter of 70", this results in a circumference variance between the 0.04" thick individual layers R1-R4 (the radius of each layer from the center) of $$\text{Circumference } @R4=\pi(70-0.04)=219.786''$$

$$\text{Circumference } @R3=\pi(70-0.08)=219.660''$$

$$\text{Circumference } @R2=\pi(70-0.12)=219.534''$$

$$\text{Circumference } @R1=\pi(70-0.16)=219.409''$$

Per revolution, there is a maximum differential length of 0.377" between the layers. As the reel runs toward empty, this differential is constant, but the circumference decreases with reducing diameter. For example, where the reel has a 12.5" minimum diameter, the circumferences of each of the four layers at minimum diameter becomes:

$$\text{Circumference } @R4=\pi(12.5-0.04)=39.144''$$

$$\text{Circumference } @R3=\pi(12.5-0.08)=39.019''$$

$$\text{Circumference } @R2=\pi(12.5-0.12)=38.893''$$

$$\text{Circumference } @R1=\pi(12.5-0.16)=38.767''$$

Per revolution, maximum differential length is still 0.377" at minimum reel diameter, but due to the lowering circumference, the strain required for equalizing the length between the inner and outer layer strips 43, 41 varies as the reel runs to empty. To equalize lengths/revolution at minimum strain/maximum diameter (in terms of percentage)=0.377/219.409=0.17% and a maximum strain to equalize lengths at minimum diameter=0.377/38.767=0.97%. Control of the unreel rate of the multi-end reel 29 into the stretcher 45 may be applied to vary the required level of tension for the required amount of stretching depending upon the full to empty depletion level of the multi-end reel 29 while unwinding of the multi-end reel 29 is in progress.

Alternatively, a tension applied to stretch the inner layer strip 43 may be provided at a worst case tension level required during the entirety of an unwinding of the multi-end reel 29, that is, the maximum strain level may be applied throughout the production run from full to empty, accepting that for a portion of the run, even the inner layer strip 43 may be subjected to stretching. The resulting increase in loss of cross-sectional area in the worst case portion of the production run may be compensated for by adjusting the initial cross-section of the supplied strip stack 25 so that at least a minimum design cross-section is obtained.

Figure 7:
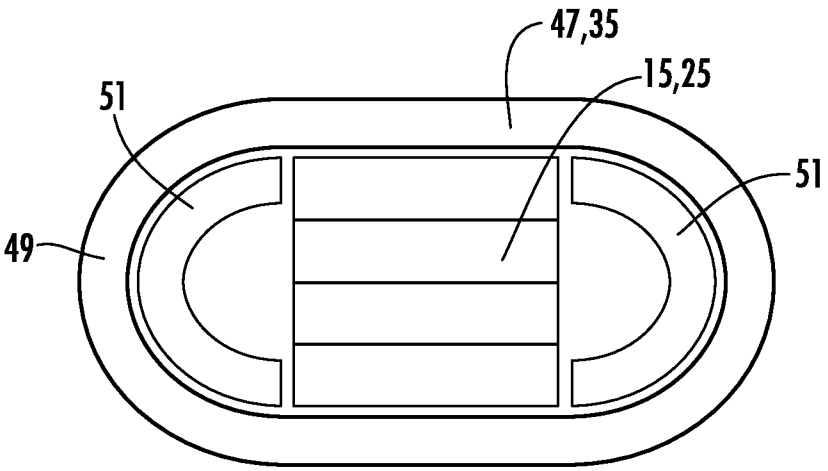
FIG. 7 is a schematic cross-section view of an exemplary insulated conductor with filler members.
Figure 6:
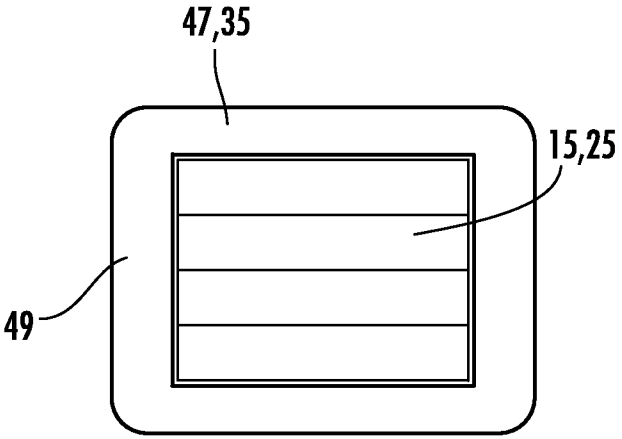
FIG. 6 is a schematic cross-section view of an exemplary insulated conductor.

Although the resulting insulated conductor 19 has significantly improved flexibility characteristics along the longitudinal axis of the cable with respect to the horizontal plane of the conductive strips 15, the insulating jacket 35 applied by the insulator extruder 37, for example as shown in FIG. 6, may create a vertical surface along the sidewall 49 of the insulated cable 19 that may be resistant to bending and/or subject to buckling during bending of the insulate cable 19. To minimize the tendency for this vertical surface to buckle and/or enhance feeding characteristics for the resulting cable, filler members 51, for example as shown in FIG. 7, may be applied to alter the cross-section geometry of the insulated conductor 19, providing a seating surface for the insulator layer 47 that replaces the vertical sidewall 49 of insulating jacklet 35 with a curved surface less likely to buckle. The filler members 51 may be applied before the insulation extruder 37 and may then be encapsulated in place at the sidewalls of the strip stack 25 as the insulator layer 87 is applied.

One skilled in the art will appreciate that the methods disclosed herein enable fabrication of a flexible electrical power cable with significant cost efficiency and/or quality control characteristics.

Table of Parts

| | |
|---|---|
| 3 | sector |
| 5 | tube |
| 7 | sectoring device |
| 9 | lead-in feature |
| 11 | guiding mandrel |
| 13 | tube cutter |
| 15 | conductive strip |
| 17 | packaging container |
| 19 | insulated conductor |
| 21 | flattening roller |
| 23 | strip conditioner |
| 25 | stack |
| 27 | gathering tool |
| 29 | multi-end reel |
| 31 | corrugation pattern |
| 33 | corrugator |
| 35 | insulating jacket |
| 37 | insulator extruder |
| 39 | reel |
| 41 | outer layer strip |
| 43 | inner layer strip |
| 45 | stretcher |

-continued

Table of Parts

| | |
|---|---|
| 47 | insulator layer |
| 49 | sidewall |
| 51 | filler member |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A method for manufacturing an electrical cable, comprising: dividing a tube into a plurality of sectors by passage across a sectoring device;

gathering the sectors into a stack one upon the other, along a horizontal axis, by passage of the sectors through a gathering device; and surrounding the stack with an insulating jacket by passage of the stack through an insulator extruder.

2. The method of claim 1, further including passing the sectors each through a flattening roller, the flattening roller flattening the sectors into a generally flat rectangular cross-section.

3. The method of claim 1, further including passing at least one of the sectors through a strip conditioner; the strip conditioner imparting at least one of a dimensional, a surface and a forming treatment upon the at least one sector.

4. The method of claim 1, further including passing the stack through a corrugator.

5. The method of claim 1, wherein the sectoring device includes a guiding mandrel dimensioned to center the tube upon the sectoring device.

6. The method of claim 1, wherein the sectoring device includes tube cutters positioned around a circumference of the guiding mandrel.

7. The method of claim 1, wherein the sectoring device has an outer diameter equal to or greater than an inner diameter of the tube.

8. The method of claim 1, wherein between the dividing of the tube into sectors and surrounding the stack with the insulating layer is a continuous process.

9. The method of claim 1, wherein the sectors are collected in individual reels.

10. The method of claim 1, wherein the stack is collected in a multi-end reel after the gathering tool.

* * * * *